United States Patent [19]

Harsányi et al.

[11] Patent Number: 4,611,764

[45] Date of Patent: Sep. 16, 1986

[54] CRUSHING EQUIPMENT WITH AIR-JET, IN PARTICULAR FOR CRYSTALLINE MATERIALS

[75] Inventors: József Harsányi; János Papp, both of Budapest, Hungary

[73] Assignee: CHINOIN Gyogyszer es Vegyeszeti Termekek Gyara Rt., Budapest, Hungary

[21] Appl. No.: 569,736

[22] Filed: Jan. 10, 1984

[30] Foreign Application Priority Data

Jan. 12, 1983 [HU] Hungary ..... 90/83

[51] Int. Cl.[4] ..... B02C 19/06

[52] U.S. Cl. ..... 241/39; 241/300

[58] Field of Search ..... 241/5, 39, 40, 294, 241/300, 57

[56] References Cited

U.S. PATENT DOCUMENTS 2,611,546 9/1952 Posselt ..... 241/300 X 3,173,827 3/1965 Altmann et al. ..... 241/39 X 3,741,485 6/1973 Gage et al. ..... 241/5 X 4,248,387 2/1981 Andrews ..... 241/5

FOREIGN PATENT DOCUMENTS 644698 5/1937 Fed. Rep. of Germany ..... 241/57

1362373 8/1974 United Kingdom .

1559139 1/1980 United Kingdom .

*Primary Examiner*—Mark Rosenbaum

[57] ABSTRACT

Crushing equipment with air-jet, in particular for the comminution of crystalline materials, comprising a cylindrical grinding chamber, nozzles and a nozzle carrying crown. The nozzle carrying crown is assembled of two releasably interconnected crown-halves and an exchangeable wearing ring protecting the outlet opening of the nozzle, and the two crown-halves form the seat of the wearing ring. Useful life of the nozzles of the equipment is practically unrestricted. The nozzles are fit, without a thread, either into one of the crown-halves or between them.

1 Claim, 2 Drawing Figures

CRUSHING EQUIPMENT WITH AIR-JET, IN PARTICULAR FOR CRYSTALLINE MATERIALS

BACKGROUND OF THE INVENTION

The invention relates to crushing equipment with air-jet, in particular for crushing crystalline materials, consisting of a cylindrical grinding chamber, nozzles and a nozzle carrying crown.

Essentially, crushing equipment with air-jet used in milling practice consists of a horizontally or vertically arranged cylindrical grinding chamber and the nozzles in the cylinder jacket; nozzles are fixed with a thread in the nozzle carrying crown, e.g. the solutions described in British Pat. No. 1 559 139 and U.S. Pat. No. 3,741,485.

The solid, in general crystalline material to be ground introduced into the known crushers is put into a whirling motion under the effect of the gas allowed to stream under high pressure, while comminution is taking place primarily by the mutual percussion of the particles of the material to be ground.

In the known crushers, in the course of the grinding process the solid particles exert a strong abrasive effect not only on each other but on the inner cylinder jacket of the nozzle carrying crown, in particular in the vicinity of the outlet opening of the nozzles. Within a relatively short operational period the smooth surface of the cylinder jacket and the outlet opening of the nozzles become deformed. As a consequence, the streaming pattern also changes and more and more undesired whirls appear resulting in the deterioration of efficiency, while simultaneously with increased abrasive wear the quality of grinding becomes also unacceptable.

To prevent this phenomenon, with the known equipment nozzles and the nozzle carrying crown are to be exchanged frequently which represent very expensive parts of the crushers requiring utmost accurate processing. Considering that a crusher of the middle size contains about 35 to 45 nozzles, the frequent exchange thereof involves considerable economic disadvantages. Essential improvement cannot achieved, even if these strucutral parts are made of highly wear-resistant materials or if a suitable coating is applied thereon (see British Pat. No. 1,362,373).

The aim of the invention is to eliminate disadvantages of the known solutions and simultaneously to develop a crusher with air-jet with economical maintenance.

The aim set can be achieved by assembling the nozzle carrying crown of the known equipment from several parts.

SUMMARY OF THE INVENTION

The invention is based on the recognition that in so far as the part of the nozzle carrying crown not in contact with the comminuted particles is still faultless, while the other parts are strongly worn, therefore, if the nozzle were assembled of several parts, only the actually worn part would have to be exchanged and the parts of satisfactory quality could be used for a long period.

With the crusher with the air-jet according to the invention the nozzle carrying crown consists of two crown-halves interconnected in a releasable manner, and of an exchangeable wearing ring protecting the outlet opening of the nozzle, where the two crown-halves commonly form the seat of the exchangeable wearing rings.

BRIEF DESCRIPTION OF THE DRAWING

The invention will be described in detail by means of a preferred embodiment serving as an example, with the aid of the drawing enclosed, wherein.

DETAILED DESCRIPTION OF A PREFERRED EMBODIMENT

Figure 1A:
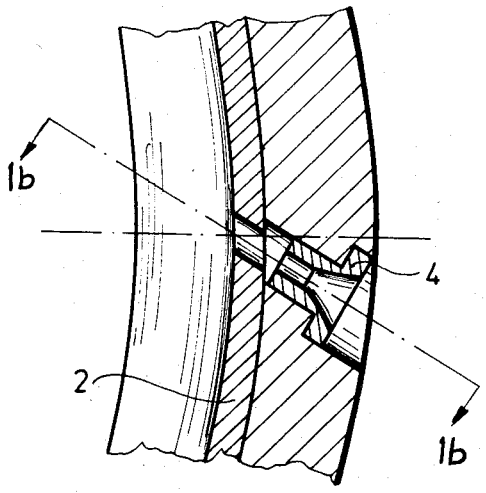
FIG. 1*a* illustrates a cross-section of the equipment at one of the nozzles, and FIG. 1*b* a section along line 1*b*—1*b* of FIG. 1*a*.
Figure 1B:
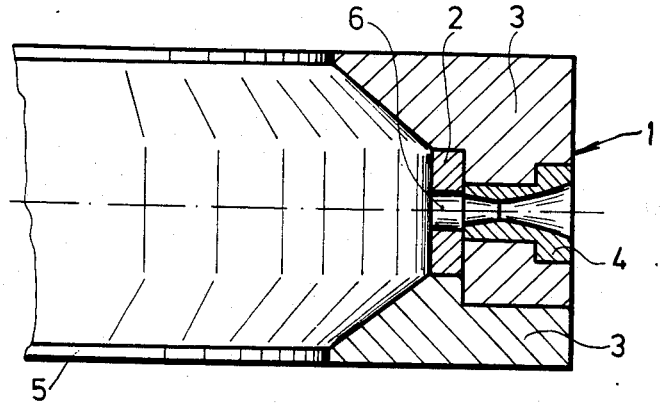

As it becomes obvious from FIGS. 1*a* and 1*b*, a nozzle carrying crown 1 is formed by two crown-halves 3 and a wearing ring 2. The two crown-halves 3 are interconnected by means of known releasable connecting elements and they enclose the wearing ring 2 in a stable manner. The ring can be easily exchanged. Behind the wearing ring 2 a nozzle 4 is found and a outlet opening 6 thereof—discharging into the cylindrical grinding chamber 5—is protected by the wearing ring 2.

The nozzle 4 can be made of any optional material, i.e. metal, carbides or a suitable synthetic material. Expediently the nozzle is fitted without any thread into one of the crown-halves 3 or between the two crown-halves.

It goes without saying that the equipment according to the invention is provided with the usual openings—which can be closed—for the charge and respectively discharge of the solid material to be comminuted, as well as with a pipeline-system for introducing the gas needed for comminution under the proper pressure.

The advantages of the equipment according to the invention are as follows:

Nozzles can be manufactured not only of metals or carbides but also of synthetic materials materials, as e.g. thermoplastic or thermosetting or castable, cold polymerizating synthetic materials. This enables economical mass production, remarkable surface fineness can be obtained without individual labor-intensive processing; a forming tool has to be made only once with suitable accuracy and by its application a lot of identical nozzles can be produced. In this manner streaming pattern formation in the crusher can be considerably improved.

In contrast to known equipment threaded nozzles and threaded bores for receiving them become superfluous. With the equipment according to the invention the nozzles are fixed either in one of the crown-halves or between two crown-halves without any thread.

Taking into consideration that with the equipment according to the invention only the wearing ring is subjected to the intensive abrasive effect of the comminuted particles, it suffices if only the wearing ring is made of a harder, tougher and more wear-resistant alloy or elastic rubber, teflon etc. in compliance with the characteristics of the material to be ground, while the two crown-halves can be made of a cheaper material.

As the nozzles do not come into direct contact with the material to be ground, their useful life is nearly unrestricted. This involves considerable economic advantages, as production of the nozzles requires highly accurate processing.

What we claim:

1. Crushing equipment, in particular for the comminution of crystalline materials, comprising: a cylindrical grinding chamber, at least one nozzle having an outlet opening leading into said chamber for introducing into said chamber a fluid under pressure, a crown carrying said nozzle and being composed of two releasably interconnected crown halves, and an exchangeable wear ring protecting said outlet opening, from material in the chamber, said two crown halves forming a seat for the exchangeable wear ring.

* * * * *